US007771170B2

(12) United States Patent
Seiler

(10) Patent No.: US 7,771,170 B2
(45) Date of Patent: Aug. 10, 2010

(54) TURBINE WHEEL

(75) Inventor: Martin Seiler, Wettingen (CH)

(73) Assignee: ABB Turbo Systems AG, Baden (CH)

( * ) Notice: Subject to any disclaimer, the term of this patent is extended or adjusted under 35 U.S.C. 154(b) by 167 days.

(21) Appl. No.: 11/976,708

(22) Filed: Oct. 26, 2007

(65) Prior Publication Data

US 2008/0063528 A1 Mar. 13, 2008

Related U.S. Application Data

(63) Continuation of application No. PCT/CH2006/000176, filed on Mar. 24, 2006.

(30) Foreign Application Priority Data

Apr. 27, 2005 (EP) ..... 05405319

(51) Int. Cl.
*F01D 5/22* (2006.01)

(52) U.S. Cl. ..... 416/182; 416/183

(58) Field of Classification Search ..... 415/182, 415/193, 181, 185

See application file for complete search history.

(56) References Cited

U.S. PATENT DOCUMENTS 3,040,670 A 6/1962 Schenck et al.
4,335,997 A 6/1982 Ewing et al.
4,659,288 A 4/1987 Clark et al.

FOREIGN PATENT DOCUMENTS

EP 1 462 607 A1 9/2004
GB 514420 11/1939
JP 10-131704 A 5/1988
JP 10131704 A * 5/1998

OTHER PUBLICATIONS

PCT/ISA/210 and PCT/ISA/237 for PCT/CH2006/000176 dated May 23, 2006.
European Search Report dated Feb. 22, 2006.

* cited by examiner

*Primary Examiner*—Edward Look
*Assistant Examiner*—Dwayne J White
(74) *Attorney, Agent, or Firm*—Buchanan Ingersoll & Rooney PC

(57) ABSTRACT

The hub/blade junction of each rotor blade is placed with respect to the scalloping surface ($F_1$+$F_2$) such that this surface is supported as symmetrically as possible by the rotor blade. The turbine wheel with three-dimensionally curved rotor blades has scalloping in the area of the hub rear wall, and in consequence is subject to reduced stresses caused by scalloping deformation.

5 Claims, 3 Drawing Sheets

TURBINE WHEEL

RELATED APPLICATIONS

This application claims priority under 35 U.S.C. §119 to EP Application 05405319.4 filed in European Patent Office on 27 Apr. 2005, and as a continuation application under 35 U.S.C. §120 to PCT/CH2006/000176 filed as an International Application on 24 Mar. 2006 designating the U.S., the entire contents of which are hereby incorporated by reference in their entireties.

TECHNICAL FIELD

A field of exhaust-gas turbochargers is disclosed. It relates in particular to a turbine wheel of a radial or mixed-flow turbine.

BACKGROUND INFORMATION

Compact exhaust-gas turbochargers generally have exhaust-gas turbines with a strictly radial (radial turbine) or angled (mixed-flow turbine) inlet flow. The exhaust-gas flow is deflected through the turbine wheel, and flows away in the axial direction.

The turbine wheels of radial and mixed-flow turbines are often provided with scalloping. The scalloping refers to a cutout in the rear wall of the hub of the turbine wheel, between the individual rotor blades. The scalloping serves mainly for reducing the moment of inertia by cutting out material in the radially outermost area of the turbine wheel.

According to U.S. Pat. No. 4,659,288 the scalloping contour may be symmetrical with respect to the exhaust-gas inlet edge of the individual rotor blades of the turbine wheel. The scalloping contour runs to a point, or is rounded off, towards the exhaust-gas inlet edge. The scalloping contour is generally likewise rounded off at the radially innermost point on the scalloping contour, that is to say at the lowest point of the cutout in the rear wall of the hub of the turbine wheel, thus resulting in a scalloping contour with a continuous profile from the exhaust-gas inlet edge to the exhaust-gas inlet edge of adjacent rotor blades.

Alternatively, as described in EP 1 462 607 A1 for example, the scalloping contour may have an asymmetric profile between the exhaust-gas inlet edges of adjacent rotor blades.

Particularly in the case of mixed-flow turbines such as those used in the TPS . . . D/E series of ABB exhaust-gas turbochargers, the rotor blades have three-dimensional curvature. On the one hand, each hub/blade junction, that is to say the junction between the rotor blade and the hub, has a curved profile with respect to the radial line. On the other hand, the hub is inclined backwards, toward the turbine shaft, in the area opposite the radially outermost edge. The three-dimensional blade shape can result in asymmetric deformation in the area of the scalloping, at a high rotational speed and when the turbine wheel is thermally loaded. If the scalloping contour is symmetrical, as shown in the illustration in FIG. 2, the rear wall of the hub is drawn radially outwards by the powerful centrifugal forces. The surface on the pressure side of the rotor blade in particular is rotated about the foot of the rotor blade, as is indicated by the thick arrow in the figure. This results in high stresses in the area of the scalloping contour, in particular at the lowest point and, in the extreme, these can restrict the life of the turbine wheel.

SUMMARY

A turbine wheel is disclosed having three-dimensionally curved rotor blades and scalloping in the area of the hub rear wall, in which the stresses which result from scalloping deformation during operation are reduced.

According to the disclosure, this object is achieved in that the hub/blade junction of each rotor blade is placed with respect to the scalloping surface such that this surface is supported as symmetrically as possible.

For this purpose, the rotor blade is moved towards the pressure side, with respect to the scalloping contour. The exhaust-gas inlet edge of the rotor blade, which is curved towards the pressure side, is therefore not located at the highest point of the scalloping contour but is moved toward the pressure side, when the scalloping contour is symmetrical and is in the form of a wave.

In one exemplary embodiment, the hub/blade junction of the rotor blade divides the surface of the rear wall of the shaft hub, which is bound by the scalloping contour, into two surface elements of equal size. The load on the two surface elements with respect to the deformation during operation is thus matched, and the maximum load on one side is reduced.

BRIEF DESCRIPTION OF THE DRAWINGS

The disclosure will be explained in more detail in the following text with reference to the figures.

DETAILED DESCRIPTION

Figure 1:
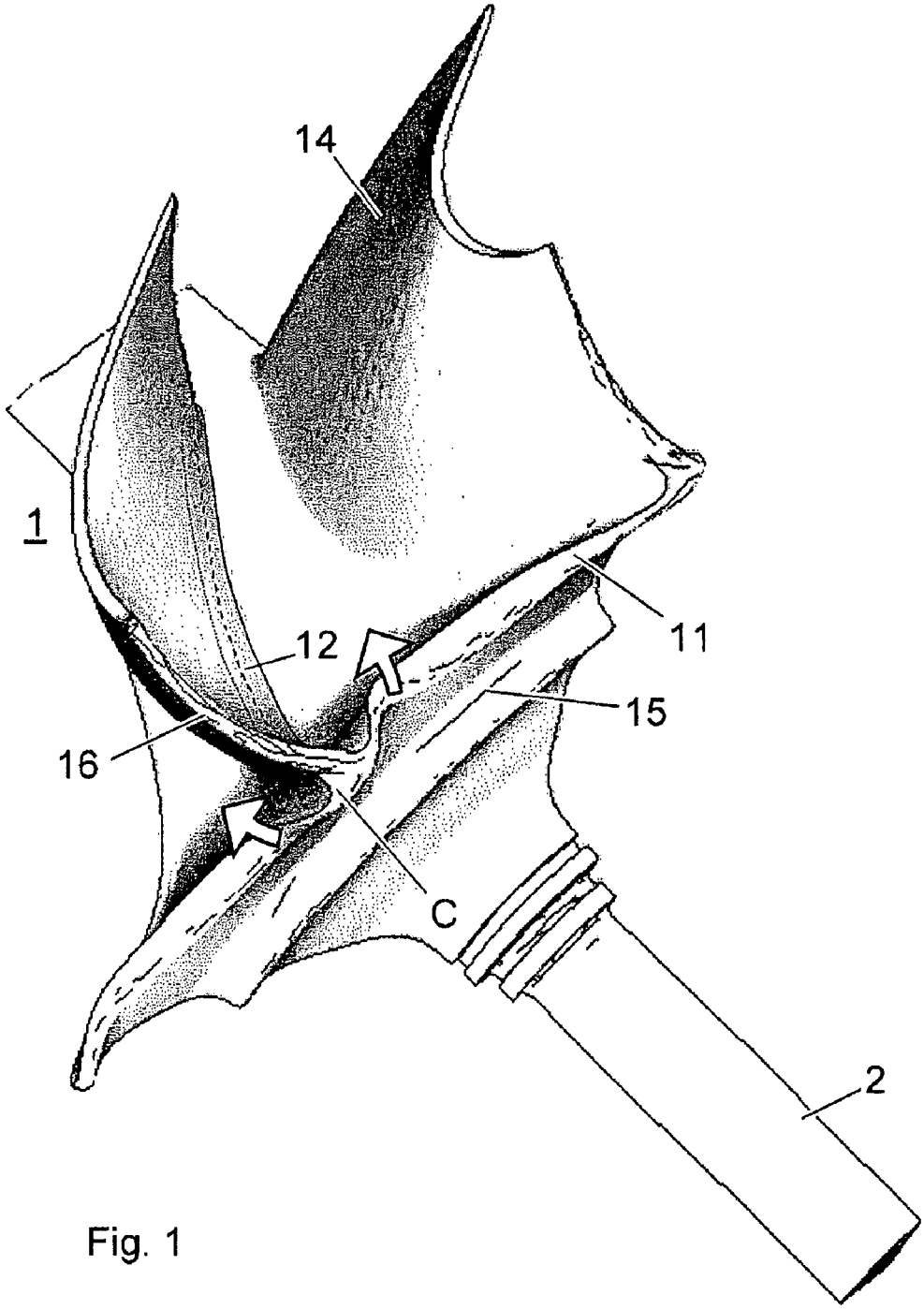
FIG. 1 shows an exemplary turbine wheel which has been configured according to the disclosure and is illustrated on load, with rotor blade exhaust-gas inlet edges that have been displaced with respect to the point of symmetry of the scalloping contour.

The turbine wheel shown in FIG. 1 has a hub 15 and a plurality of rotor blades 14, arranged all round the hub. The hub is arranged at the end of a turbine shaft 2, which is mounted, such that it can rotate, in the housing of an exhaust-gas turbocharger. The hub may be connected to the turbine shaft by an integral material joint, or via a threaded joint. A compressor wheel, which is not illustrated, is arranged at the other end of the turbine shaft. During operation, the turbine wheel drives the compressor wheel. The illustrated turbine wheel in a mixed-flow turbine has only a small number of rotor blades. The number of rotor blades may be chosen freely, depending on the operational requirements. The inlet edges 16 of the rotor blades of the turbine wheel are arranged at right angles to the flow direction in a mixed-flow turbine. In this case, the inlet edge is not at right angles to the radial line, as in the case of a radial turbine, but is arranged inclined at an angle to the radial line. In addition, the rear wall of the hub is inclined towards the turbine shaft in the radially outermost area of the turbine wheel. This radially outermost area of the hub has a scalloping contour, that is to say material is in each case cut out of the hub rear wall between two rotor blades.

Figure 4:
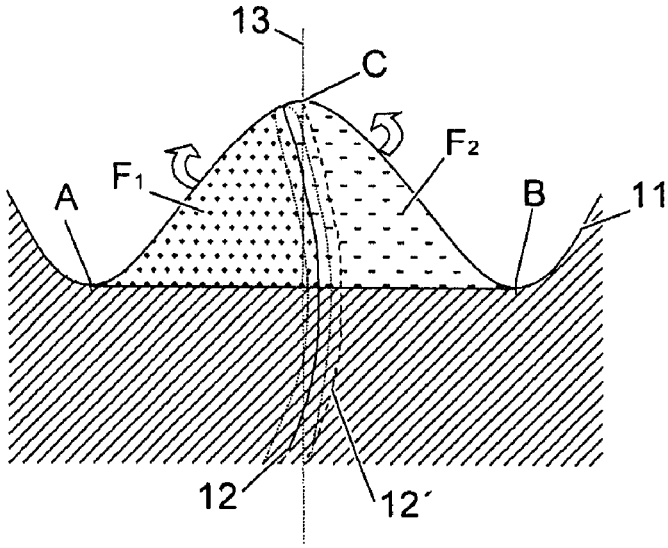
FIG. 4 shows a schematic illustration of the rear wall of the hub of the turbine wheel shown in FIG. 3, in the form of a section along the hub surface (IV-IV).

The rotor blades and the hub of the turbine wheel are generally cast integrally or milled from solid, that is to say the rotor blades are firmly connected to the hub. A junction curve is created between the rotor blade contour and the hub surface in the area of the attachment. In order to simplify the explanation of the disclosure and to simplify the illustration, the hub/blade junction 12 is reduced to a line in the figures. However, dotted lines in FIG. 4 illustrate not only the hub/blade junction 12 but also the effective profile of the junction curve between the rotor blade contour and the hub surface.

Figure 3:
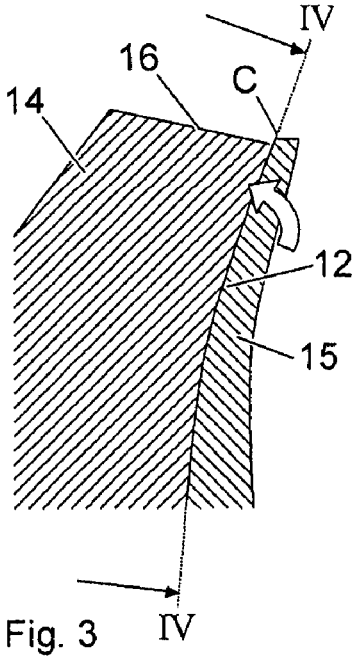
FIG. 3 shows a schematic illustration of the rear wall of the hub of the turbine wheel shown in FIG. 1, in the form of an axial section.

As has already been mentioned, the rotor blades of the turbine wheels are curved three-dimensionally. The hub/rotor junction 12 therefore has a double-curved profile, as shown in FIG. 3 and FIG. 4.

The rotor blades of the turbine wheel according to the disclosure are arranged with respect to the scalloping contour 11 such that the surfaces of the hub rear wall are supported uniformly on both sides of the rotor blades. This can be more easily explained with reference to FIG. 4.

If an imaginary hub/blade junction of the rotor blades were to run following the dashed line 12', then the inlet edge of the rotor blade would cross the scalloping contour 11 at the point of symmetry C. In the illustrated case, with the scalloping contour in the form of a wave, this would be the highest point of the wave. The surfaces on the two sides of the imaginary hub/blade junction 12' would be of different size, and would be unequally distributed with respect to the profile of the imaginary hub/blade junction 12'. At high rotation speeds during operation of the turbine, the hub rear wall would be rotated in the area of the larger area on the pressure side of the rotor blade. The hub wall, which is inclined towards the shaft, deviating from the radial line, would have centrifugal forces acting on it, and would be deformed in the radially outward direction.

Figure 2:
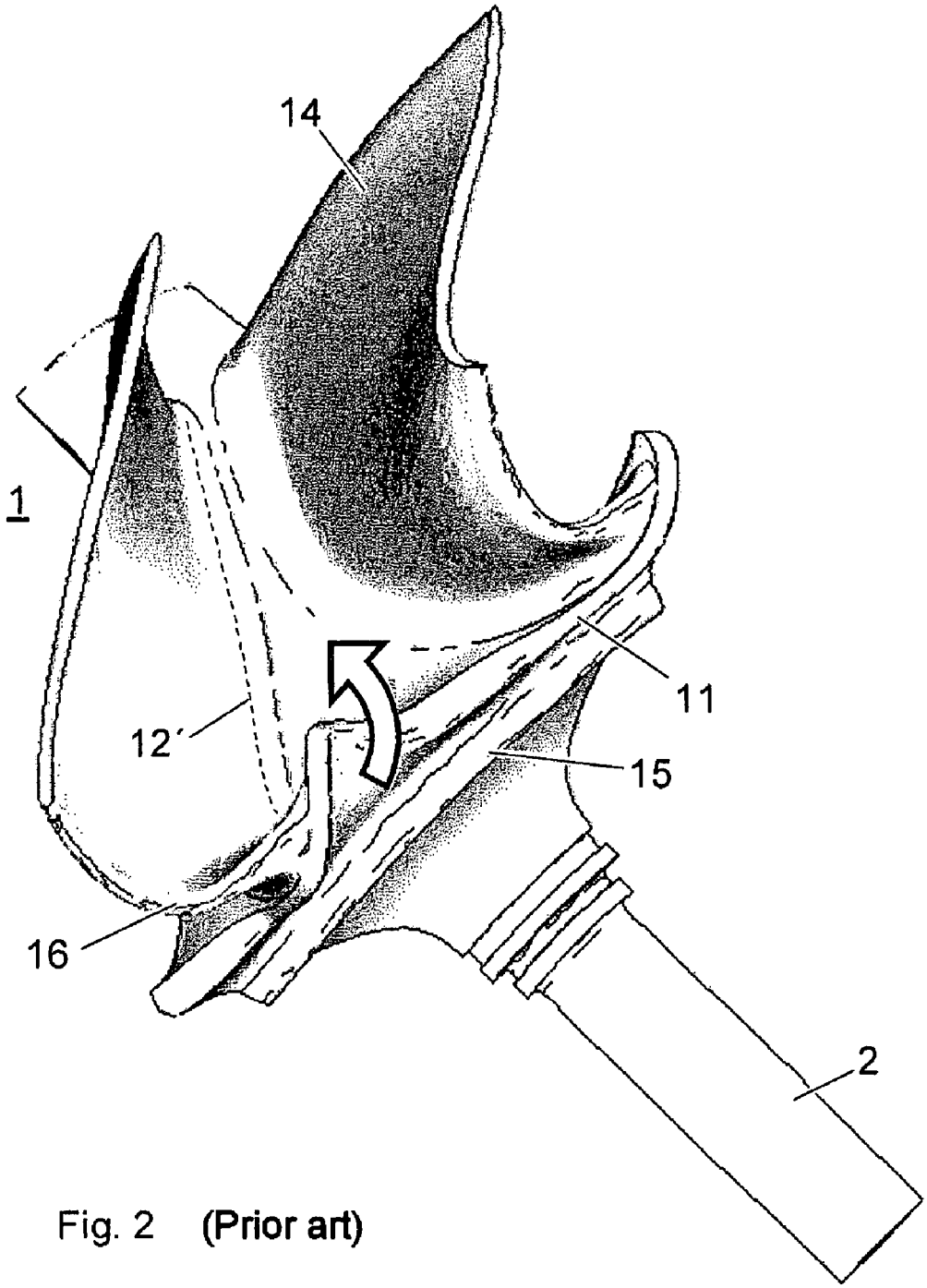
Fig. 2 (Prior art)
FIG. 2 shows a turbine wheel, illustrated on load, according to the prior art, with rotor blade exhaust-gas inlet edges arranged at the point of symmetry of the scalloping contour.

This twisting can also clearly be seen in the illustration of the turbine wheel according to the prior art in FIG. 2, and is indicated by an arrow. The figure shows a turbine wheel on load, so that the deformation caused by the centrifugal forces can clearly be seen. The radially outermost edge of the hub of the turbine wheel is loaded with a high stress, because of this twisting.

However, if, according to the disclosure, the hub/blade junction 12 of the rotor blade now runs with an offset towards the pressure side with respect to the point of symmetry C of the scalloping contour, the two surfaces $F_1$ and $F_2$ are matched to one another. The two surfaces are bounded by the scalloping contour 11 on the one hand, and by a connecting line between the radially innermost points A and B of the scalloping contour on the pressure side and suction side of the rotor blade, on the other hand. The curved hub/blade junction 12 now runs centrally through the two surfaces, and supports them optimally. The twisting resulting from the centrifugal forces is reduced and the stresses on the turbine wheel are decreased. This reduced twisting can also be seen in the illustration of the turbine wheel according to the disclosure shown in FIG. 1. The two arrows indicate the slight deformation. The figure shows the turbine wheel on the same load as the turbine wheel shown in FIG. 2. The radially outermost edge of the hub of the turbine wheel is loaded with considerably less stress, because the twisting is reduced.

The precise extent of the movement of the rotor blade with respect to the scalloping contour depends on various factors. For example, the curvature of the hub/blade junction and the precise shape of the scalloping contour are significant.

The scalloping contour of the illustrated turbine wheels has a symmetrical profile, in the form of a wave. Alternatively, however, the scalloping contour may also have an asymmetric profile, and may, for example, run such that it is matched to the profile of the rotor blade in the area of the hub/blade junction.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Turbine wheel
2 Turbine shaft
11 Scalloping contour
12, 12' Hub/blade junction
13 Radial line which bisects the hub surface within the scalloping contour
14 Turbine rotor blade
15 Turbine wheel hub
16 Exhaust-gas inlet edge
A Radially innermost (lowest) points on the scalloping contour on the pressure side
B Radially innermost (lowest) points on the scalloping contour on the suction side
C Intersection point of the radial line with the scalloping contour
$R_{11}$ Maximum external radius of the restraint projection
$F_1$ Pressure-side hub surface within the scalloping contour
$F_2$ Suction-side hub surface within the scalloping contour

What is claimed is:

1. A turbine wheel of a radial or mixed-flow turbine having a hub and rotor blades with each rotor blade being connected in each case along a curved hub/blade junction to the hub and with the rotor blades being designed and arranged on the hub such that the hub/blade junction runs curved towards the pressure side of the rotor blades, deviating from the radial direction, with the hub having a scalloping contour between, in each case, two adjacent rotor blades in the area of a hub rear wall, with a hub surface (F1+F2) in the area of each rotor blade being bounded by the scalloping contour between the radially innermost points (A, B) of the scalloping contour on the suction side and pressure side of the rotor blades and by a straight line passing through these two points, and with a radial line which bisects the hub surface (F1+F2) intersecting the scalloping contour at an intersection point (C), wherein the terminal ends of the hub/blade junction of each rotor blade is in each case arranged offset towards the pressure side of the rotor blade with respect to the intersection point (C), and wherein the hub/blade junction of each rotor blade equally divides into two halves the hub surface (F1+F2) which is bounded by the scalloping contour between the radially innermost points (A, B) of the scalloping contour on the suction side and on the pressure side of the rotor blades, and by a straight line passing through these two points.

2. The turbine wheel as claimed in claim 1, wherein the scalloping contour is symmetrical with respect to the radial lines, and in that the intersection point (C) of the radial lines with the scalloping contour is located at the radially highest point on the scalloping contour.

3. A mixed-flow turbine, comprising a turbine wheel as claimed in claim 1.

4. A radial turbine, comprising a turbine wheel as claimed in claim 1.

5. An exhaust-gas turbocharger, comprising a radial or mixed-flow turbine having a turbine wheel as claimed in claim 1.

* * * * *